US009180351B2

(12) United States Patent
Reams

(10) Patent No.: US 9,180,351 B2
(45) Date of Patent: Nov. 10, 2015

(54) GOLF TEE APPARATUS

(71) Applicant: Double D Golf, LLC, Hermitage, MO (US)

(72) Inventor: Bernard A. Reams, Kansas City, MO (US)

(73) Assignee: Double D Golf, LLC, Hermitage, MO (US)

( * ) Notice: Subject to any disclaimer, the term of this patent is extended or adjusted under 35 U.S.C. 154(b) by 0 days.

(21) Appl. No.: 14/250,045

(22) Filed: Apr. 10, 2014

(65) Prior Publication Data

US 2014/0309057 A1 Oct. 16, 2014

Related U.S. Application Data

(60) Provisional application No. 61/810,405, filed on Apr. 10, 2013.

(51) Int. Cl.
*A63B 57/00* (2015.01)

(52) U.S. Cl.
CPC ..... *A63B 57/0018* (2013.01)

(58) Field of Classification Search
CPC ... A63B 57/00; A63B 57/0018; A63B 57/005
USPC ..... 473/387–403; D21/717, 719
See application file for complete search history.

(56) References Cited

U.S. PATENT DOCUMENTS

| | | | | | |
|---|---|---|---|---|---|
| 1,595,130 | A * | 8/1926 | Wilcox | 473/392 |
| 1,933,239 | A * | 10/1933 | Boe | 473/388 |
| 3,424,457 | A * | 1/1969 | Robertson | 473/257 |
| 3,473,812 | A * | 10/1969 | Pelzmann | 473/278 |
| 3,506,263 | A * | 4/1970 | Arrington | 473/278 |
| 4,192,504 | A * | 3/1980 | Clugage | 473/257 |
| 4,205,841 | A * | 6/1980 | Silva et al. | 473/257 |
| 4,328,969 | A * | 5/1982 | Wright | 473/390 |
| 4,367,879 | A * | 1/1983 | Messer | 473/278 |
| 5,193,803 | A * | 3/1993 | Flick, III | 473/392 |
| 5,738,598 | A * | 4/1998 | Wu | 473/392 |
| 5,913,737 | A * | 6/1999 | Park | 473/386 |
| 6,004,228 | A * | 12/1999 | Adam | 473/403 |
| 6,062,990 | A * | 5/2000 | Pierce | 473/387 |
| D443,007 | S * | 5/2001 | Schneider | D21/717 |
| 7,140,982 | B2 * | 11/2006 | Park | 473/387 |
| 2001/0029212 | A1 * | 10/2001 | Dovigi | 473/387 |
| 2006/0287135 | A1 * | 12/2006 | Pommereau | 473/387 |
| 2007/0066422 | A1 * | 3/2007 | Cirone et al. | 473/387 |

* cited by examiner

*Primary Examiner* — Steven Wong
(74) *Attorney, Agent, or Firm* — Erickson Kernell Derusseau & Kleypas, LLC

(57) ABSTRACT

A golf tee apparatus for altering a golf ball's launch angle from an initial launch angle to a final launch angle, and for simultaneously imparting a spin for increasing the ball's roll distance. The apparatus includes a penetrating element for inserting the tee into a surface. A stem extends from the penetrating element, and a platform element extends from the stem. The platform element includes a ball setting surface and an impact surface, the impact surface extending from the ball setting surface at an angle.

23 Claims, 4 Drawing Sheets

GOLF TEE APPARATUS

CROSS-REFERENCE TO RELATED APPLICATIONS

This application claims the benefit of provisional application Ser. No. 61/810,405, filed on Apr. 10, 2013, entitled GOLF TEE APPARATUS.

FIELD

The invention relates generally to the field of golf tees. More specifically, the invention relates to the field of golf tees that improve a golf ball's launch angle upon a misstrike, potentially increasing the overall horizontal distance for which the ball remains in the air, and by imparting spin, also allow the ball to travel further on the ground than with the usage of conventional tees.

BACKGROUND OF THE INVENTION

It is often an object of a golfer to hit the golf ball such that the ball has sufficient vertical flight, and also travels the intended horizontal distance; however, it may take several years before a golfer is able to develop the required expertise to cause the ball to have the desired trajectory. Indeed, anyone who has ever played golf likely remembers his first several times at the golf course or driving range, and the frustration that follows when the golfer is unable to hit the ball properly from a tee.

For example, the golfer's swing may have an unintended negative angle of attack, which would produce a lower launch angle than a swing with a positive angle of attack, and consequently, cause the ball to hit the ground earlier than intended. Air provides less resistance against the ball's travel path than the ground, and as such, with a negative angle of attack, the ball may not travel the intended horizontal distance. Or, the golfer may, for example, unintentionally "top" the ball, i.e., hit the golf ball above its equator, which may cause the ball to hit the ground immediately, or at least, render the ball unable to rise up at the desired launch angle. Experienced golfers with well-developed swings, although less prone to making such errors, may nevertheless commit them from time to time.

A golfer may also intend for the golf ball to continue to roll after it hits the ground, so as to achieve a desired horizontal distance. Such continued rolling may be effectuated by imparting a spin on the golf ball that counters the friction between the ball and the ground. Such spin, however, cannot easily be conveyed to the ball using conventional tees.

SUMMARY

The present invention includes a golf tee apparatus for altering a golf ball's launch angle from an initial launch angle to a final launch angle, and for simultaneously imparting a spin for increasing the ball's roll distance. The apparatus includes a penetrating element for inserting the tee into a surface. A stem extends from the penetrating element, and a platform element extends from the stem. The platform element includes a ball setting surface and an impact surface, the impact surface extending from the ball setting surface at an angle.

BRIEF DESCRIPTION OF THE DRAWINGS

Illustrative embodiments of the present invention are described in detail below with reference to the attached drawing figures, wherein.

DETAILED DESCRIPTION

Embodiments of the present invention provide systems and a method for launching a golf ball at a positive launch angle, notwithstanding the fact that the golf ball has been struck improperly; and by imparting spin, the present invention also causes the ball to roll on the ground further than the golf ball would have rolled with such a misstrike if placed on a conventional tee. To disclose this invention, certain terms are first being defined, and unless otherwise specified, will have the following meaning—the golf ball's "equator" refers to an imaginary circle whose plane is parallel to the plane of the surface on which the golf tee is secured (e.g., the ground surface), and which divides the golf ball into congruent upper and lower portions. A "launch angle" is generally defined as the initial angle of ascent of the ball with the ground surface immediately after impact with a golf club; herein, an "initial launch angle" is the angle of ascent of the ball with the ground surface immediately after impact with a golf club, while a "final launch angle" is the angle of ascent of the ball with the ground surface immediately after the ball interacts with the tee set forth. A "loft angle" is the built-in angle of a face of the club with a club's vertical shaft; drivers generally available on the market have a loft angle between eight to 13 degrees, 2 Woods have a loft angle between 12 to 15 degrees, while 3 Woods have a loft angle between 12 to 17 degrees, etc. An "angle of attack" is the angle of the club head's path as it travels toward and contacts the ball. For example, if the club head is traveling level with the ground on impact with the ball, the angle of attack would be zero. Where the club head is moving up through impact, i.e., where the ball is hit on the upswing, the angle of attack would be positive. A negative angle of attack, on the other hand, would mean that the club head is moving down upon impact, i.e., the ball is hit on the downswing.

Figure 1:
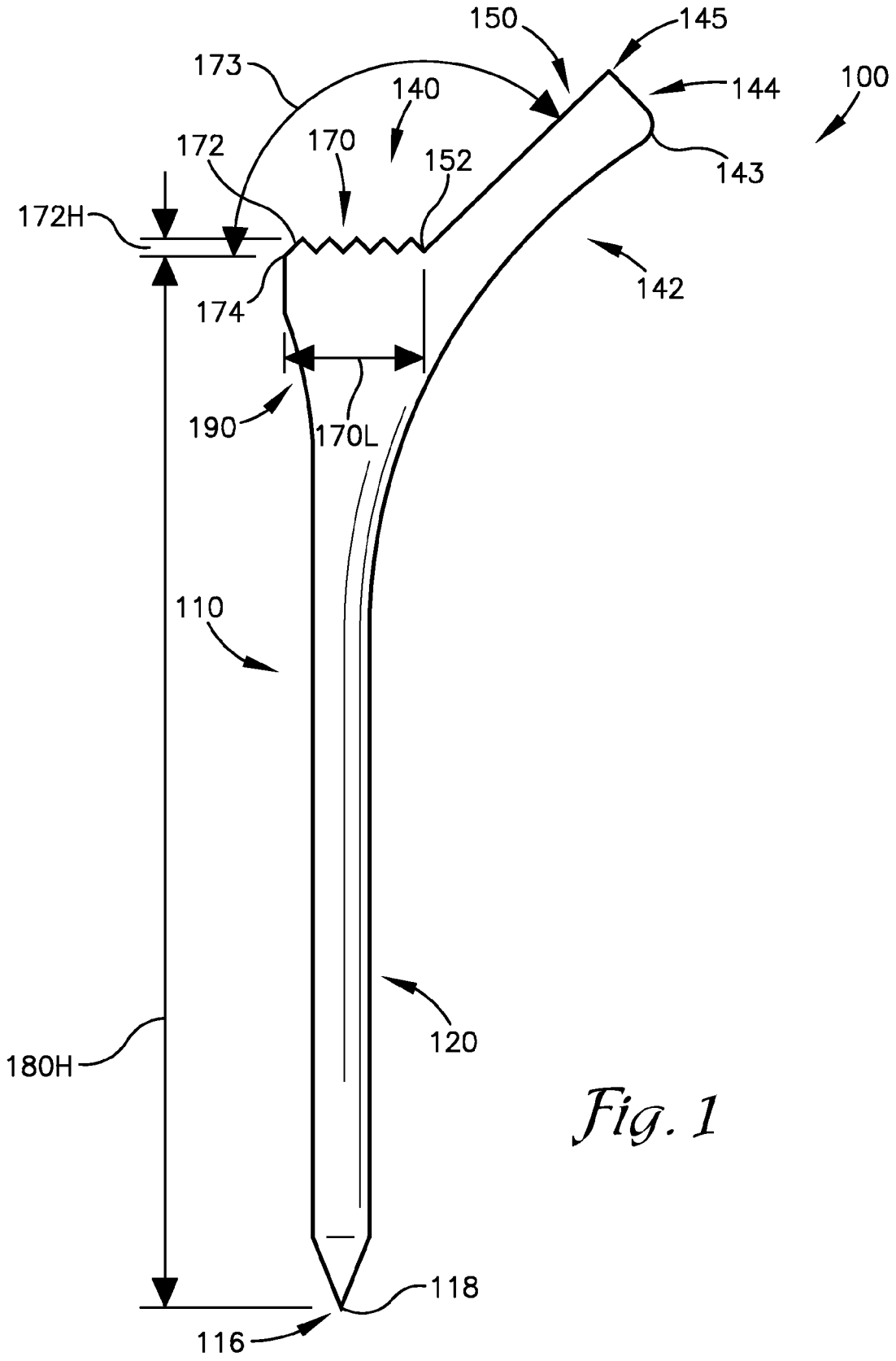
FIG. 1 is an elevation view of a golf tee apparatus in accordance with the current invention.

FIG. 1 shows an embodiment 100 of a golf tee 110 in accordance with the teachings of the current invention. The tee 110 has a penetrating element 116, a stem 120 and a platform element 140. The penetrating element 116 has a defined tip 118, which is configured to penetrate a surface where the tee 110 is desired to be set. The penetrating element 116 shown in FIG. 1 is V-shaped, but it is also possible for the penetrating element to be of other shapes, such as a cylinder, or to not have a defined tip 118. A cylindrical stem 120 extends from the penetrating element 116. Much like the penetrating element 116, it is possible for the stem 120 to not be cylindrical, and be, for example, rectangular.

A platform element 140 extends from the stem 120, and has a first curved side 142, an angled side 144, a ball setting surface 150, an impact surface 170, and a second curved side 190. The first curved side 142 is adjacent the stem 120 and terminates at a first rounded edge 143. The angled side 144 commences from this first rounded edge 143 and terminates at a second rounded edge 145. The first rounded edge 143, i.e., the transition from first curved side 142 to the angle side 144, need not be well-defined and distinct.

Figure 3:
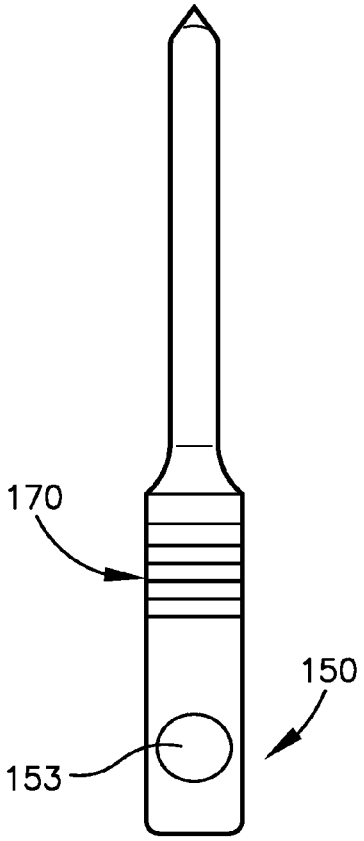
FIG. 3 is a plan view of the golf tee apparatus of FIG. 1.

A ball setting surface 150 is adjacent the angled side 144, and has an edge 152. Much like the first rounded edge 143, the second rounded edge 145, i.e. the transition from the angled side 144 to the ball setting surface 150, need not be distinct. The ball setting surface 150 has a depression 153 (see FIG. 3), which is configured to allow a golf ball to be stably placed thereon.

The impact surface 170 extends from the ball setting surface edge 152, and terminates at an edge 174. The impact surface 170 may have one or more abrasions 172, however, it is also possible for the impact surface 170 to be devoid of any abrasions 172. The abrasions 172 may be made out of a rubber-based compound material, or some other suitable material. A height **172*h* of the abrasions 172 is preferably around 1/16 of an inch, however, this height 172*h* may vary. A length 170*l* of the impact surface 170, i.e., the distance between the ball setting surface edge 152 and the edge 174 may vary, but is preferably about 3/8 of an inch. An angle 173 between the ball setting surface 150 and the impact surface 170** is generally within the range of 120 to 150 degrees, and is preferably 135 degrees.

Figure 2:
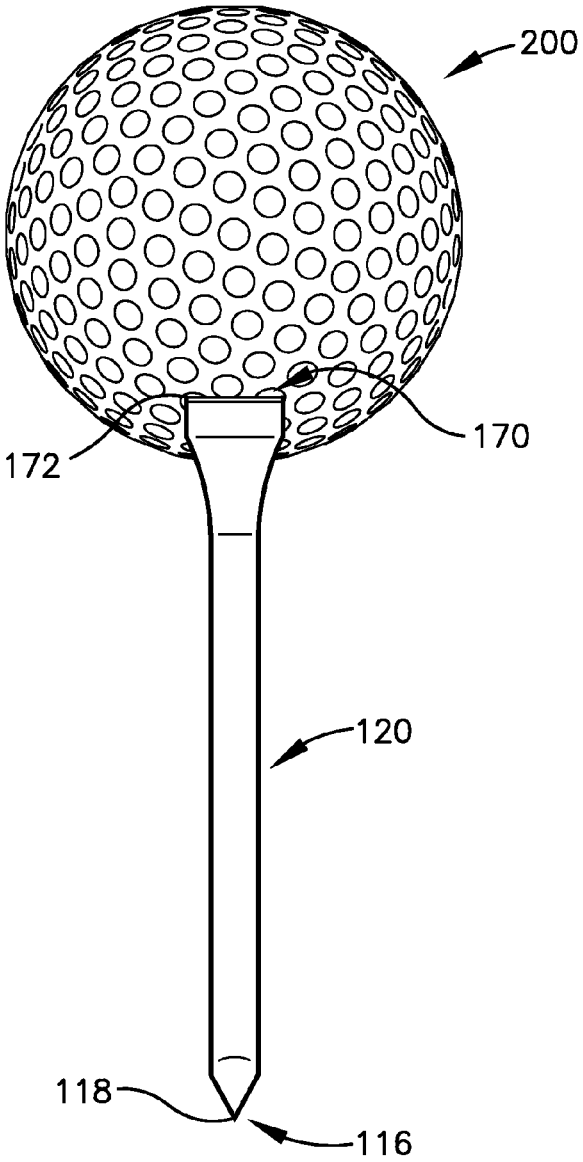
FIG. 2 is a side elevation view of the golf tee apparatus of FIG. 1.

The second curved side 190 is adjacent the impact surface 170, and merges with the stem 120. A height **180*h*, i.e., the distance from edge 174 (or the impact surface 170) to the tip 118 is generally within the range of three to four inches, with a preferred height of three and one-half inches. It is possible for the first and second curved sides 142, 190 to not be curved, or for the angled side 144 to not be angled or even exist, so long as an angle between 120 and 150 degrees is maintained between the ball setting surface 150 and the impact surface 170. Also, while the tee 110 is drawn as a two-dimensional figure in FIG. 1, it will readily be understood that the tee 110 is a three-dimensional object that can support a golf ball 200 (see FIG. 2**), and may be comprised of wood, plastic, or any structurally rigid material suitable for a golfing environment.

Figure 4:
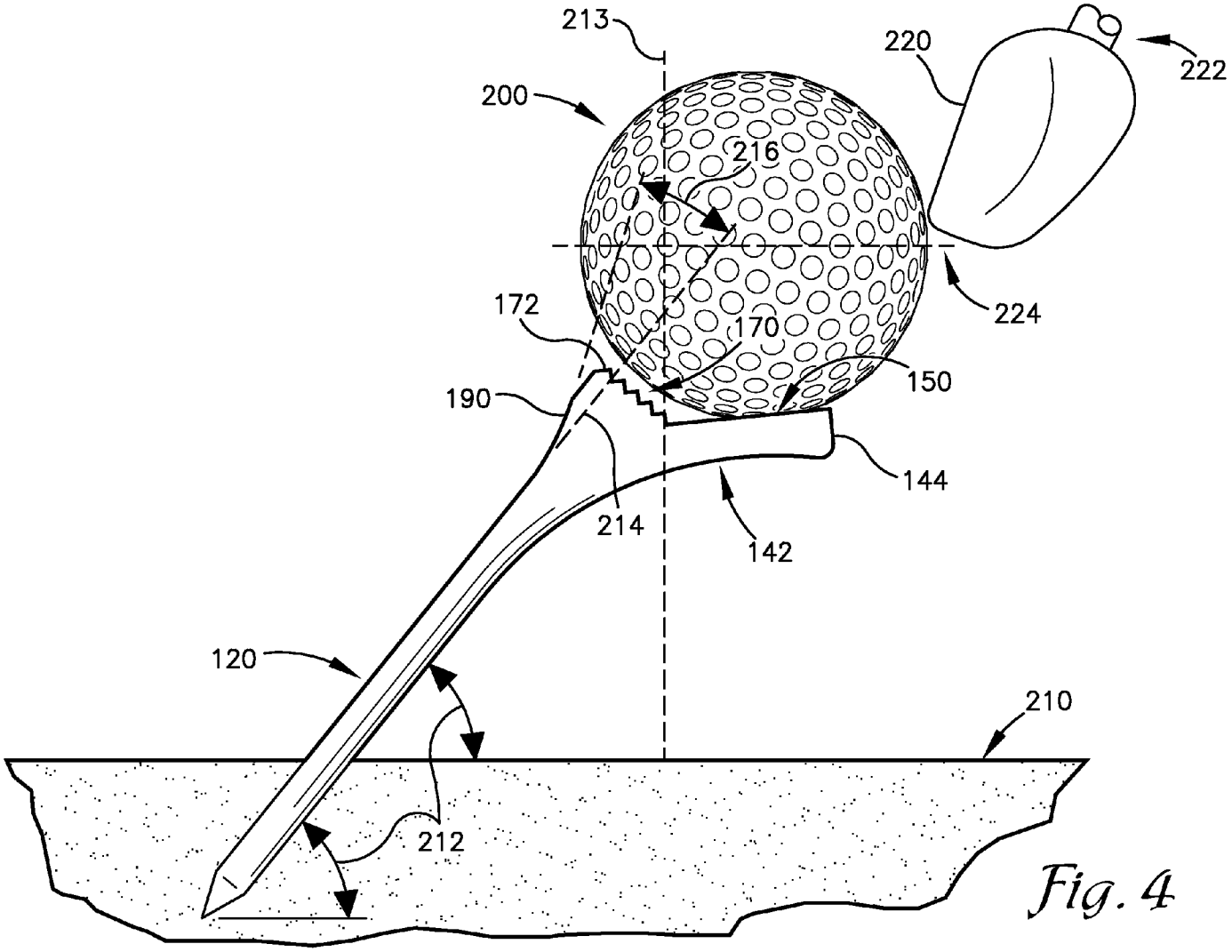
FIG. 4 is a side elevation view of the golf tee apparatus in use with a ball.

Attention is now directed to FIG. 4, with the help of which, working of the tee 110 can be explained. The tee 110 is first inserted into a ground surface 210 (or some other surface), such that an angle of insertion 212 between the stem 120 and the ground surface 210 is approximately 45 degrees. This angle of insertion 212 causes the ball setting surface 150 to be generally parallel to the ground surface 210. This means that if a vertical line 213 was drawn perpendicular to the ground surface 210, an angle 214 between the impact surface 170 and the vertical 213 would be about 45 degrees. Also, if the second curved side 190 and the stem 120 were extrapolated, an angle 216 between them would be about 15 degrees.

The ball 200 is placed on the ball setting surface 150. More specifically, the ball 200 is placed on the depression 153 (see FIG. 3), which is configured to hold the golf ball 200. As the ball setting surface 150 is parallel to the ground surface 210, the ball 200 rests within the depression 153 without falling off. Now consider that the ball 200 is misstruck, for example, the ball 200 is topped, as shown in FIG. 4. If placed on a conventional tee, after a golf club head 220 of a golf club 222 hits the ball 200 above an equator 224, the ball 200 would fly off the conventional tee without any significant launch angle, and strike the ground surface 210 soon thereafter. With the tee 110, however, the ball 200 would move forward and strike the impact surface 170, and because the impact surface 170 is at an angle of about 135 degrees with the horizontal (see angle 173 in FIG. 1), a significant increase in launch angle will be mechanically induced. The ball 200, thus, instead of prematurely falling to the ground surface 210, will fly off at an angled trajectory, thereby reducing the ill effects of the misstrike.

Figure 5:
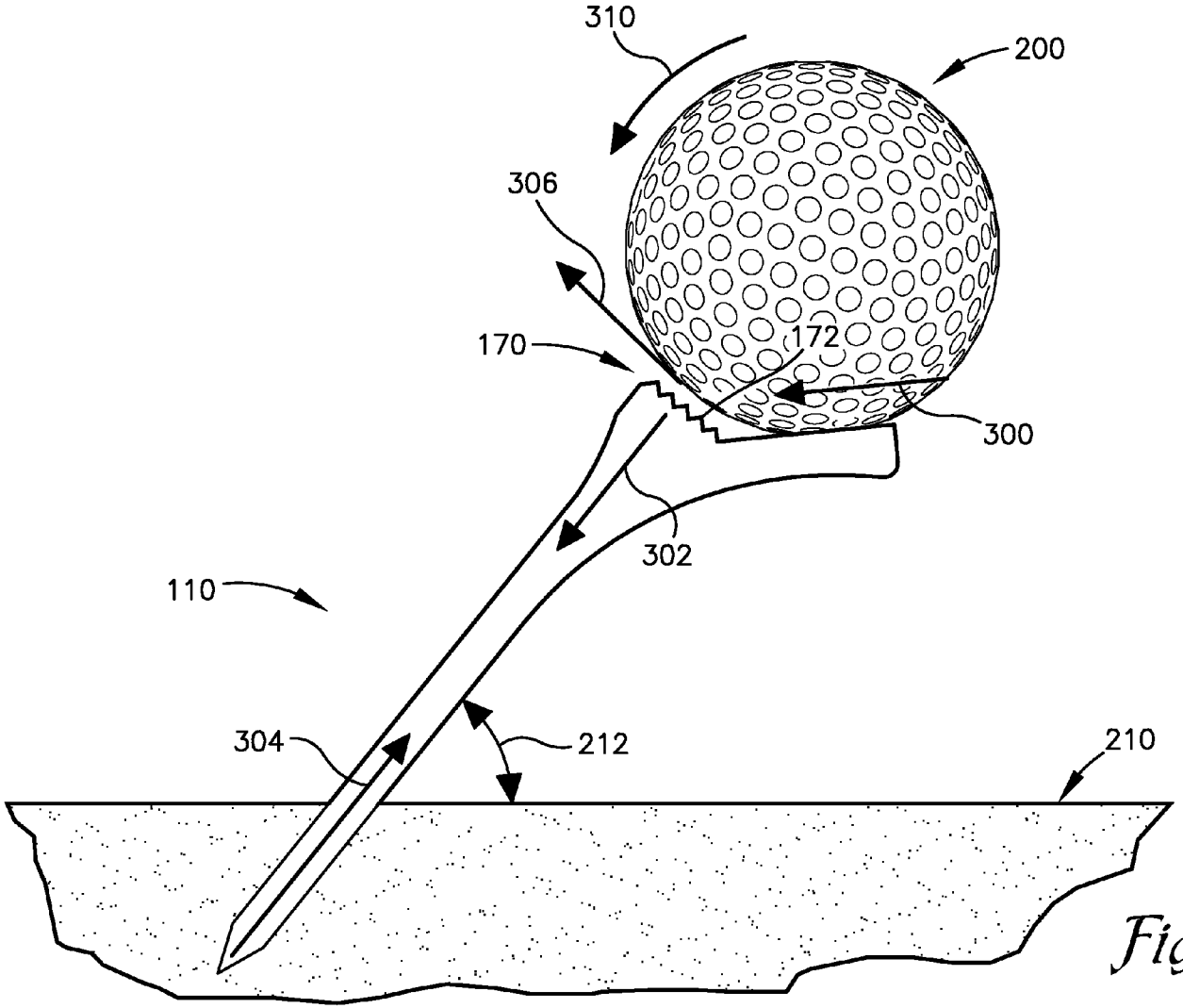
FIG. 5 is a side elevation view of the golf tee apparatus wherein a conventional vector diagram is used to illustrate applicable forces.

To explain, consider a ball 200 that has been struck parallel to the horizontal ground surface 210 (i.e., the initial launch angle is zero), as indicated by a force vector 300 (FIG. 5). If the ball 200 had been placed on a conventional tee, the ball 200 would simply travel parallel to the ground surface 210 for a short amount of time, and then be pulled to the ground surface 210 by the earth's gravity, whereby the friction from the ground surface 210 would cause the ball 200 to quickly come to a rest. With the tee 110, however, the ball 200 will come into contact with the impact surface 170, and travel in a direction parallel to the impact surface 170. More specifically, the force vector 300 will be equally split into force vectors 302 and 306. The vector 302 will be directed towards the ground surface 210 at an angle of about 45 degrees from the horizontal, and as the tee 110 is solidly inserted into the ground surface 210, the force vector 302 will be neutralized by a resistant force vector 304. The force vector 306, however, will cause the ball 200 to launch at an angle of about 45 degrees from the horizontal (i.e., the final launch angle is about 45 degrees). It is well known that when maximizing the horizontal travel distance of a ball 200 or other projectile, a launch angle of 45 degrees should be used, and thus, in this manner, a horizontally struck ball 200 will nevertheless obtain significant flight and cover a considerably greater horizontal distance than with conventional tees.

Moreover, as the ball 200 contacts the impact surface 170, it will strike and travel across the abrasions 172, the friction from which will attempt to selectively slow the progression of the ball 200. This friction will impart a rotational force 310 on the ball 200, (i.e., as the ball 200 is struck at the top and selectively slowed at the bottom by the abrasions 172, a rotational force 310 is induced). When looking at FIG. 5, this force 310 is counter-clockwise, but it will readily be understood that depending on where a golfer stands in relation to the tee 110, this same force 310 may appear clockwise. Once the ball 200 hits the ground surface 210, this rotational force 310 will work against the friction produced by the interaction of the ball 200 and the ground surface 210, and will thus allow the ball 200 to roll along for a further distance than the ball would without any rotational force 310. Hence, a horizontally struck ball 200 will first be launched into the air, increasing the ball 200's horizontal travel distance in the air, and also spun in a direction that is conducive to extending the roll distance (i.e., the distance traveled by the ball 200 after impacting the ground surface 210), further increasing the horizontal travel distance of the ball. It is also possible to induce such spin on the ball 200 with an impact surface 170 devoid of the abrasions 172, albeit with significantly diminished effectiveness.

The forces described above relate to a ball 200 that has been struck horizontally, however, it will be obvious to those skilled in the art that a ball 200 struck at any initial launch angle will be ultimately launched at the preferred angle of 45 degrees with spin, so long as the ball 200 squarely interacts with the impact surface 170. It is also possible to hit the ball 200 so as to avoid the impact surface 170 altogether, in which case, the tee 110 will serve akin to conventional tees. Moreover, a golfer may hit the ball 200 at such an angle that the ball 200 touches a corner of the impact surface 170, or gently brushes against the abrasions 172, resulting in different elevations and spin. It is known to those skilled in the art that because clubs 222 have built-in loft angles, the ball 200 may have a positive launch angle notwithstanding a negative angle of attack; however, the tee 110 will nevertheless enhance the launch angle and impart spin as described above, causing the ball 200 to travel further than with the usage of conventional tees.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. One of ordinary in the art may develop alternative means of implementing the aforementioned improvements without departing from the scope of the present invention.

It will be understood that certain features and sub-combinations are of utility and may be employed without reference to other features and sub-combinations and are contemplated within the scope of the claims. Not all steps listed in the various figures need be carried out in the specific order described.

Having thus described the invention, what is claimed as new and desired to be secured by Letters Patent is as follows:

1. A tee for supporting a golf ball when inserted in the ground, said tee comprising:

a stem having a first end and a second end opposite said first end;

a ball setting surface having a depression for retaining a golf ball and extending at an angle of approximately 45 degrees from said first end of said stem; and said first end of said stem having an impact surface generally perpendicular to said stem;

whereas said ball setting surface is generally parallel to the ground when said second end of said stem is inserted into the ground to support the golf ball; and whereas said impact surface imparts a launch angle of approximately 45 degrees and forward spin to the golf ball when the golf ball is struck by a golf club and the ball contacts said impact surface.

2. The tee of claim 1 wherein said second end of said stem is V-shaped to penetrate the ground.

3. The tee of claim 1 wherein said ball setting surface includes a depression for receiving a portion of a golf ball surface.

4. The tee of claim 3 wherein said depression is circular.

5. The tee of claim 1 wherein said impact surface includes one or more abrasions.

6. A tee for supporting a golf ball when inserted in the ground, said tee comprising:

a stem having a first end and a second end opposite said first end; and a platform element extending from said first end of said stem;

said platform element having a ball setting surface extending at a first angle from said first end of said stem and an impact surface fixed at a second angle to said first end of said stem and a third angle from said ball setting surface;

whereas said ball setting surface is generally parallel to the ground when said second end of said stem is inserted into the ground to support the golf ball; and whereas said impact surface imparts a launch angle and forward spin to the golf ball when the golf ball is struck by a golf club and the ball contacts said impact surface.

7. The tee of claim 6 wherein said second end of said stem is V-shaped to penetrate the ground.

8. The tee of claim 6 wherein said ball setting surface includes a depression for receiving a portion of a golf ball surface.

9. The tee of claim 8 wherein said depression is circular.

10. The tee of claim 6 wherein said first angle is approximately 45 degrees.

11. The tee of claim 6 wherein said second angle is approximately 90 degrees.

12. The tee of claim 6 wherein said third angle is approximately 120 to 150 degrees.

13. The tee of claim 6 wherein said third angle is approximately 135 degrees.

14. The tee of claim 6 wherein said impact surface includes one or more abrasions.

15. A tee for supporting a golf ball when inserted in the ground, said tee comprising:

a stem having a first end and a second end opposite said first end, said second end having a penetrating element for penetrating the ground; and a platform element extending from said first end of said stem;

said platform element having a ball setting surface extending at a first angle from said first end of said stem and an impact surface extending at a second angle from said first end of said stem and a third angle from said ball setting surface;

whereas said ball setting surface is generally parallel to the ground when said second end of said stem is inserted into the ground to support the golf ball; and whereas said impact surface imparts a launch angle and forward spin to the golf ball when the golf ball is struck by a golf club and the ball contacts said impact surface.

16. The tee of claim 15 wherein said penetrating element of said second end of said stem is generally V-shaped.

17. The tee of claim 15 wherein said ball setting surface includes a depression for receiving a portion of a golf ball surface.

18. The tee of claim 17 wherein said platform element includes a first curved side extending from first end of said stem to said ball setting surface.

19. The tee of claim 17 wherein said platform element includes a second curved side opposite said first curved side extending from said first end of said stem to said impact surface.

20. The tee of claim 15 wherein said second angle is approximately 90 degrees.

21. The tee of claim 15 wherein said third angle is approximately 120 to 150 degrees.

22. The tee of claim 15 wherein said third angle is approximately 135 degrees.

23. The tee of claim 15 wherein said impact surface includes one or more abrasions.

* * * * *